106-18.28 SR
XR 4,013,804
1x 2020N
1DK

United States 4,013,804
Gruetzman Mar. 22, 1977

[54] METHOD AND COMPOSITION FOR TREATING WOOD AND COATED WOODEN ARTICLES OBTAINED THEREBY

[75] Inventor: Stanley A. Gruetzman, Shoreview, Minn.

[73] Assignee: Andersen Corporation, Bayport, Minn.

[22] Filed: Mar. 5, 1976

[21] Appl. No.: 664,166

Related U.S. Application Data

[63] Continuation-in-part of Ser. Nos. 507,371, Sept. 19, 1974, abandoned, and Ser. No. 575,365, May 7, 1975, Pat. No. 3,996,410.

[52] U.S. Cl. ..... 427/33; 21/7; 106/15 R; 252/500; 427/27

[51] Int. Cl.[2] ..... B05D 3/06

[58] Field of Search ..... 427/27, 30, 33; 252/500, 518, 382, 383; 106/15 AF; 21/7

[56] References Cited

UNITED STATES PATENTS

| | | | |
|---|---|---|---|
| 3,236,679 | 2/1966 | Spiller et al. | 427/27 |
| 3,305,298 | 2/1967 | Chapman et al. | 21/7 |

FOREIGN PATENTS OR APPLICATIONS

| | | | |
|---|---|---|---|
| 22,481 | 10/1963 | Japan | 427/30 |

OTHER PUBLICATIONS

Miller, "Canadian Paint And Varnish," Feb. 1963, pp. 28, 36.

Hubert, Western Pine Ass'n. Tech. Bull. No. 6, Sept. 1, 1936.

*Primary Examiner*—John H. Newsome
*Attorney, Agent, or Firm*—Thomas M. Meshbesher

[57] ABSTRACT

The disclosed process combines preparatory biocidal treatment, water repellency treatment, and electrical conductivity treatment "in-line" with electrostatic spray coating of wooden articles. The preparatory treatment can be a single step, e.g. immersing a continuously moving line of wooden articles in a treatment bath containing a solution especially designed for this process. The solution is very low in solids (e.g. less than 20%, preferably less than 10%), and the solvent for these solids contains some polar solvent.

10 Claims, No Drawings

4013804
OR IN 427/33

METHOD AND COMPOSITION FOR TREATING WOOD AND COATED WOODEN ARTICLES OBTAINED THEREBY

CROSS REFERENCE TO RELATED APPLICATIONS

This application is a continuation-in-part of application Ser. No. 507,371, filed Sept. 19, 1974, now abandoned and Ser. No. 575,365, filed May 7, 1975, now U.S. Pat. No. 3,996,410.

1. Field of the Invention

This invention relates to a method for coating wooden substrates by means of electrostatic projection of a pigment-containing composition. An aspect of this invention relates to means and techniques for preparatory treatment of the wooden substrate, e.g. improving the electrical conductivity of the wood surface prior to electrostatic coating. Another aspect of this invention relates to means and techniques for a preparatory treatment wherein the wood, in a single pretreatment step, is treated with a preservative composition and is given sufficient conductivity to be used in an electrostatic spraying process. Still another aspect of this invention relates to wood preservative and biocidal compositions particularly useful in this invention and wooden articles treated and coated by the process of this invention.

2. Description of the Prior Art

It is well known that polar liquids such as water or alcohols and ionizable compounds such as quaternary ammonium salts can be used as a preparatory treatment for a wooden substrate, whereby the electrical conductivity of the wooden substrate is increased to the point where it can be used in an electrostatic spraying process.

The art of preserving and/or sterilizing wood with wood preservative agents and the like is highly developed; however, the teachings of this art are ordinarily considered to be unrelated to the various techniques of preparatory treatment of wood substrates to improve electrical conductivity for electrostatic spraying. There are several reasons for the remoteness of the two arts, as will be explained subsequently.

The conventional method for preparing wooden articles (e.g. millwork) for spray painting generally includes the following steps:

First, a preservative (e.g. a mercury compound or a halogenated phenol) is dissolved in a hydrocarbon solvent such as V, M, and P naphtha, mineral spirits, or similar solvents boiling in temperature ranges up to about 400° F. (about 205° C.). The wooden articles are then soaked in the preservative solution on a batch basis.

Second, the treated wooden articles are then dried — typically on a batch basis — to remove the hydrocarbon solvent. So long as the wood is not "sinker stock" and contains no blue stain, the treated wooden articles can be completely dried. However, a considerable amount of wood used as raw material can, under commonly occurring conditions, be subjected to the action of bacteria or molds, resulting in phenomena such as the characteristic blue stain. This bacteriological or other biological action opens up closed cells in the internal cellular structure of the wood, resulting in substantial interconnection of cells. During the soaking step in the hydrocarbon preservative solution, hydrocarbon solvent penetrates deep into the interior of the wood and becomes sufficiently trapped to be incapable of removal or evaporation by oven drying techniques. Thus, sinker stock and blue stained wood is ordinarily rejected as unsuitable for spray painting because of the undesirable hydrocarbon residue.

Third, once the wood has been given a suitable preservative treatment, it is ready for painting, e.g. spray painting. Perhaps the most economical and efficient type of spray painting is the technique known as electrostatic spraying. In this technique, the paint or other pigment-containing composition is mechanically atomized to form spray particles or droplets which are electrostatically charged. The electrostatic charge is designed so that there is a large difference in potential between the charged paint or coating particles and the substrate which is to be painted or coated. Typically, the substrate is grounded and the coating particles have a large positive or large negative charge. The efficiency of the electrostatic spraying is improved when carried out in a humid atmosphere which facilitates ionization.

When the substrate to be painted is non-conductive, as in the case of a wooden substrate, a preparatory treatment to improve electrical conductivity is ordinarily needed in addition to the preservation treatment. Combining the conductivity-improving treatment with preservation and water proofing treatments is desirable in that it has the advantage of reducing the number of process steps. However, a number of difficulties would be expected if the combination of steps was carried out on a continuous production line basis.

The first problem relates to the length of time required for penetration of the wood surface with water proofing and preserving agents and the like. The traditional practice is to soak the wooden article for three minutes or more. For a conventional electrostatic spray painting production line, which may be moving at 10 or 20 or 30 ft. per minute (e.g. 3 – 15 m/minute), the wood preservation and/or waterproofing treatment alone could require a highly elongated treatment bath which would be a cumbersome addition to any production line.

Even more troublesome, the wooden articles continuously emerging from the preparatory treatment bath would have to be dried before the electrostatic spraying step. This might require an even more elongated oven or air dryer or vacuum arrangement or the like. A key factor in the length of drying time is the "percent solids" of the preparatory treatment composition. (The term "solids" is used herein to refer to all essentially non-volatile materials in the treatment bath, whether solid or liquid.) For example, if the treatment solution is more than 20% by weight solids (non-volatile material), it is difficult to evaporate or "flash-off" even the most volatile solvents under normal ambient conditions. The ideal preparatory treatment solution would be very low in solids and very high in relatively volatile solvents.

Unfortunately, the formulation of a suitable low-solids solution is by no means straightforward. Traditionally, wax is used as the waterproofing agent, and is ordinarily present at a level of several percent by weight in the treatment solution. The biocidal preserving agents presently preferred in the industry, i.e. the halogenated phenols have high "threshold concentrations" (see NWMA - M - 1 - 70, a publication of the National Woodwork Manufacturers Association), e.g. 5% by weight of the treating solution. Essentially non-volatile plasticizing agents are typically included in the treatment solution to make the halogenated phenols more effective. If the conductivity of the wooden substrate is to be enhanced for electrostatic spraying, it may be necessary to include several percent by weight of an ionizable compound which is compatible with the solvent system. (In most cases, true solutions are more effective in treating wood than dispersions or emulsions, and the typical prior art practice is to select ingredients for the preparatory treatment which are mutually compatible.)

At the present time, the prior art does not appear to provide sufficient guidelines for reducing the solids level in the pretreatment solution down to 10 or 15% and still obtain all the desirable goals referred to previously; that is, a continuous production line for the preparatory treatment and electrostatic spraying of wooden articles wherein the wooden articles are given a very short (e.g. less than 1 minute) combined treatment for biocidal action, water repellency, and improving of electrical conductivity with a low solids solution capabie of rapid evaporation essentially to dryness so that electrostatic spraying can begin without disturbing the continuity of the entire preserving and painting (or priming) process. Furthermore, not only is it desirable for the ingredients of the pretreatment solution to be compatible with each other, it is also desirable for the remaining solids (including the plasticizer for the preservative) to be substantially inert toward solvent-sensitive materials such as rubbery or resinous building materials (including weather-stripping) which may come in contact with painted millwork in window units and the like. Compatibility with wood is still another factor to consider. Some of the commonly used aliphatic and aromatic solvents used for wood preservative, waterproofing agents and the like, penetrate into the voids or pores in the wood but do not penetrate the cellulosic fibers in the internal naturally occurring structure of the wood. Treatment of the wood fibers themselves is desirable for the sake of uniformity.

There is, as pointed out previously, a wide variety of suggestions in the prior art regarding the use of wood preservative biocidal and waterproofing agents in combination with various organic solvents, plasticizers, and even agents which may incidentally improve the conductivity of the wood. Solvent levels above 80% by weight and solids levels below 20% by weight have also been suggested. However, these treatment solutions, if not specifically designed for use "in line" with an electrostatic spraying step can be poorly suited to a continuous process in which a moving line of wood articles is continuously run through a pretreatment step lasting less than a minute, followed by rapid evaporation or flash-off of solvents, followed by the electrostatic spraying step. Accordingly, this invention seeks to, among other things, overcome the problems of combining an in-line pretreatment step with electrostatic spraying without any substantial sacrifice of the efficiency of the known continuous electrostatic spray-painting production line techniques.

SUMMARY OF THE INVENTION

Briefly, this invention involves a process for the preservation (preferably both biocidal and water repellancy preservation) and electrostatic coating of a wooden substrate wherein the wooden substrate is placed in substantially continuous motion; directed through a preparatory treatment zone wherein the wood is treated with the preservatives, water repellents, conductivity improving agents, etc.; and then, after being continuously conveyed through an evaporation zone, is electrostatically sprayed with a pigmented coating composition, e.g. an alkyd or polyurea paint.

It has been discovered that the preparatory treatment time can be made very brief and the solids level of the preparatory treatment solution in the preparatory treatment zone (which contains the wood preservative, a wax waterproofing agent, etc.) can be reduced below 20% by weight and even below 10% by weight through the selection of suitable preparatory treatment materials and solvents. For example, it has been found that the amount of the wax water repellency agent can be reduced well below 2% by weight (e.g. 0.4 – 0.8% by weight) without sacrificing the adequacy and uniformity or consistency of the waterproofing treatment. The reasons for the startling efficiency of, among other things, waterproofing and preservative penetration is not entirely clear. Although this invention is not bound by any theory, it is theorized that polar solvents such as the $C_1$ – $C_4$ alcohols (e.g. the alkanols) have much greater compatibility with the naturally-occurring fibrous component of the wood than aliphatic, cycloaliphatic, aromatic, or other hydrocarbon (including halogenated hydrocarbon) solvents. However, it has also been found that the solvent in the preparatory treatment solution need only contain a minor amount of a polar solvent such as an alkanol in order to meet the requirements of this invention. The balance of the solvents can comprise one of the conventional coal or petroleum distillates (including straight-run distillates) or a similar relatively inexpensive hydrocarbonaceous liquid, provided that the boiling range or boiling point of the distillate is low enough. For example, the upper end of the boiling range should be below about 140° C. (about 285° F.), more preferably below 120° C. (about 250° F.).

By providing a low solids, easily evaporated liquid with sufficient "built in" electrical conductivity, a high quality preservation treatment which is also preparatory to electrostatic spraying is obtained in a relatively brief transit through the preparatory treatment zone, and sufficient evaporation of solvent is obtained in a brief transit through an evaporation zone. Accordingly, an entire series of wooden articles can be set in motion on a conventional electrostatic spraying production line, and the preparatory treatment and evaporation can be integrated or placed in-line with the electrostatic spraying process. Furthermore, the degree of uniformity of the pretreatment of the wooden substrate appears to be a unique feature of this process, and the adherence of the electrostatically sprayed paint to the treated wooden surface equals or exceeds the standards in the art.

A particularly preferred composition for use in the pretreatment or preparatory treatment zone comprises about 80 to about 99% by weight of a substantially non-aqueous, organic solvent composition comprising at least 10% by weight of a water-compatible, polar, low-boiling organic liquid (the balance of the solvent being typically a coal or petroleum distillate or the like), about 0.1 – 2% by weight of a water repellent wax, and a "threshold concentration" (NWMA-M-1-70) of a suitably plasticized conventional wood preservative, e.g. from 0.1% by weight (for phenyl mercuric oleate) to as much as 10% by weight for a halogenated phenol. Particularly for halogenated phenols, the preferred plasticizer is a polymeric polyol. The metal salt of organo-metallic types of biocidal wood preservatives are typically available commercially in a plasticized form. The polar solvent can be sufficient, by itself, to improve the conductivity of the wood; however, for stability of electrical conductivity, it is preferred to include a small amount of a non-volatile, ionizable material. Although the conventional quaternary ammonium salts are suitable for this purpose, it has been found that the solids content of the preparatory treatment solution can be significantly reduced by using a neutral or (more preferably) alkaline material which is soluble in lower alkanols and is capable of substantial or complete dissociation in water, e.g. the alkali metal hydroxides.

DETAILED DESCRIPTION

It should be noted at the outset that the process of this invention is designed for continuous or semi-continuous operation. One of the most significant applications of the process relates to the electrostatic spray painting of millwork or other wooden articles used in the manufacture of window frames, shutters, door frames, molding (e.g. brick molding) and the like. Electrostatic spray painting techniques can be used to both prime coat and finish coat these articles. These high production rates are achieved with high line speeds, e.g. in excess of about 10 feet per minute (about 3m/min.). Any preparatory treatment of the wooden articles, to be commercially practical, should be carried out at reasonably comparable line speeds. In other words, the production rate requirements have a tendency to rule out time-consuming impregnations or preliminary coating operations or evaporation steps. For example, if the wood preservation treatment were to last 3 minutes or more (the traditional length of time for water repellent and biocidal treatment of pine millwork and the like), it would ordinarily be necessary to carry out the preservation treatment before placing the wooden articles on the electrostatic spray line. In fact, this is conventionally done. The result is a cumbersome batch-style pretreatment and drying operation, necessitating the storage of a large number of treated wooden articles which are held on pallets before going on stream in the electrostatic spray line. In short, the wood-preserving pretreatment is a bottle neck. The conceptual framework of the process of this invention relates to the elimination of this bottle neck. The result is an overall production process with an overall production rate comparable to the rate of the fastest step in the process which, in this case, is the electrostatic spraying step. To achieve this overall objective, the individual steps of the overall process cannot be viewed individually, but must be viewed as integrated, cooperating elements of the whole. Once the wooden articles are set in motion (e.g. suspended from a conveying means), the sequence of operations on the articles should meet overall standards of efficiency and effectiveness. Once the express train has rolled onto the main line, so to speak, it cannot stop for crossings or slow down for curves.

The first curve, so to speak, is the preparatory treatment zone. This zone can comprise an impregnation bath or any equally convenient and effective piece of coating or impregnating equipment. The entire exposed surface of each wooden article is completely bathed in the treatment solution, which will be described subsequently. The duration of this preparatory treatment step is less than one minute, more preferably less than 30 seconds (e.g. 0.5–20 seconds). The uniformity of impregnation of the wooden surface achieved by this invention in this relatively short period of time is believed to be surprisingly good. Upon microscopic examination, few if any significant variations in the continuity of penetration could be found. Data obtained on wooden articles given a preparatory treatment according to this invention have been found to consistently equal or exceed I.S. (Interim Standard)4-70 (i.e. 60% water repellency) set by the N.W.M.A. (National Woodword Manufacturers Association), according to the standard swellometer test, N.W.M.A. M-2. (Test NWMA M-2 is for determining the water repellent effectiveness of treatment solutions.) The depth of penetration is no less than that of the conventional three-minute preservation treatment with relatively high boiling hydrocarbon-type solvents containing relatively high solids levels, e.g. about 20% by weight. This depth of penetration is particularly important with respect to biocidal treatments and is better expressed in terms of the cellular structure of the wood than in units of measurement. That is, the brief, low-solids treatment of this invention achieves a depth of penetration of a few layers of cells below the longitudinal surfaces of normal wood. As in the conventional treatments, the penetration of the end grain can be somewhat deeper. Unlike the conventional three-minute soaking treatment, however, the duration of the preparatory treatment in the process of this invention is short enough to avoid excessive end grain penetration. As a result, the ends of the wooden articles can be dried at roughly the same speed as or almost as quickly as the longitudinal surfaces, and this generalization can hold true even for sinker stock and blue stained wood.

The next step in the process is evaporation of the solvent residue remaining on and below the surfaces of the treated wooden article. Evaporation to complete dryness is not necessary. On the contrary, if the preparatory treatment solution contains no electrical conductivity agent other than the polar solvent, evaporation to complete dryness would take the wood substantially back to the non-conductive state. Some paints and primers (e.g. the polyurea type) can be adversely affected by residues of V, M, and P naphtha and the like, at least in terms of paint adherence. Fortunately, the solvent systems preferred for use in this invention do not have this adverse effect on polyurea paints and primers. Thus, the evaporation or flash-off zone is also very short and does not slow down the line.

The electrostatic spraying step is conventional and need not be described in detail. It is, nevertheless, a key feature of the overall process, and the preceding process steps are essentially designed with electrostatic spraying in mind. Typically, the overall process is designed to provide a smooth, consistent electrostatically sprayed coating of conventional thickness (e.g. 0.1–25 mils, more typically 0.5–3 mils) with good adherence to the wood substrate.

As is known in the art, it is generally simpler to arrange the electrostatic spraying equipment so that the conveyor line is grounded. This insures that electrostatically charged particles projected by the spraying station will be attracted to the individual wooden articles, resulting in a uniform and virtually flawless coating on each article. See, for example, the discussion in column 2 of U.S. Pat. No. 3,147,137 (Glass et al) issued Sept. 1, 1964. As pointed out by Glass et al, appropriate operations can be followed if it is desired to coat only one side (or other limited portion) of a given substrate.

The conventional details of electrostatic spray-coating techniques are described in patent literature and other literature of the Ransburg Electro-Coating Corporation. Electrostatic equipment is also available from this company. See, for example, the various patents of Lester L. Spiller (U.S. Pat. No. 3,399,075, etc.) owned by this company. See also U.S. Pat. No. 3,348,965 (Drum) also owned by Ransburg. As pointed out in the Drum patent, potential differences used in electrostatic spray systems typically range from 10kv to about 100kv. For a typical arrangement of circuitry with respect to an electrostatic spray "loop," see the drawing of the aforementioned Glass et al patent. Once the wooden articles have been given the preparatory treatment and then spray painted according to the teachings of this invention, additional steps which can be desirable (e.g. paint drying steps, additional coating steps, and the like) can be carried out in the conventional manner. Spray coated compositions can also be unpigmented.

Wooden Substrates Useful in the Process

Typically, the wooden articles treated and coated according to this invention are pieces of millwork or the like, e.g. elongated wooden strips similar to those described in U.S. Pat. No. 3,511,691 (Johnson et al), issued May 12, 1970. As pointed out in the Johnson et al patent, a typical elongated strip comprising fibrous natural wood material is normally porous and liquid absorbent. Typically, the longitudinal axis of the elongated strip is substantially parallel to the wood grain and the terminal ends of the strip are more or less transverse to the longitudinal axis and the elongated external surfaces. The wood can be hardwood or softwood. Various species of pine are the most commonly used softwoods, e.g. Ponderosa pine and sugar pine. Other species of both hardwoods and softwoods will occur to those skilled in the art. The types of treated and coated millwork produced according to this invention have been described previously in a general way. Among the examples of such treated and coated millwork articles obtained according to the teachings of this invention are siding materials, window sashes and frames, doors and door jambs, etc. This millwork is vulnerable to damaging environmental conditions such as excess humidity, temperature extremes, fungus growth, wood boring insects, etc. unless the wood surface is treated (as in this invention) with agents which reduce the hydrophilic character at the surface of the wood and inhibit mold formation, repel insects, and the like.

The wood preservative solutions will now be described in detail. These solutions typically comprise a biocidal agent, a plasticizer for the biocidal agent, a waterproofing wax, the solvent system, and preferably, dissolved in the solvent system, an electrical conductivity-improving agent. Miscellaneous additional conventional ingredients, such as iron inhibitors, can also be included.

As pointed out previously, wooden articles which have been given the preparatory treatment of this invention are believed to have a unique uniformity of surface treatment which extends to an adequate depth along the longitudinal surfaces of the wood and does not extend to an excessive depth into the end surfaces, even in the case of sinker stock and blue stained wood.

The Wood Preservative Agents

Although a variety of copper and mercury compounds have been successfully used as biocidal agents in the treatment of wood (e.g. phenyl mercuric carboxylates and the compounds disclosed in column 2, line 67 et seq. of U.S. Pat. No. 3,511,691) the relatively low toxicity (to humans) of the halogenated phenolic compounds presently appears to provide a significant advantage over the metal compounds. In the context of this application, an agent which is "biocidal" or has preservative activity means that the agent has toxicity toward a *Lenzites Trabea* Pers. ex Fr. (Madison 617), a standard strain of fungus maintained in the ATCC collection. Compounds of the formula Ar-HgOCOR, wherein Ar is aromatic and R is aliphatic, are very toxic toward this species, e.g. one to two orders of magnitude more toxic than the phenolic agents. The phenolic type wood preservatives can be either in the phenol or phenolate form, and alkali metal phenolates are well known in the art for this purpose. The halogenated phenols have two disadvantages; they are more active and effective when in solution, and impregnating solutions of these compounds should contain significant concentrations of the phenol or phenolate, e.g. 1 – 10% by weight, more typically 4 – 6% by weight. These are not serious disadvantages in the context of this invention. First, it has been found that the crystalline or solid halogenated phenol can be, in effect, plasticized with a polymeric polyol which is inert toward solvent-sensitive weatherstripping and the like and which has a vapor pressure under normal ambient conditions which is essentially at or near zero. The polyol apparently permits the halogenated phenol to behave as if it were in solution, but the polyol "solvent" (or plasticizer) does not evaporate under the conditions of use, thus insuring essentially permanent biocidal or biostatic activity. (Halogenated phenols such as pentachlorophenol also have insect repellent activity.) The possible disadvantages adherent in the high "threshhold concentration" (NWMA-M-1-70) of the halogenated phenols have been substantially avoided by keeping the other solids in the preparatory treatment composition (including the plasticizer) at the lowest possible levels consistent with efficiency and efficacy for the preservation and conductivity-improving treatment, e.g. consistent with minimum satisfactory performance under NWMA I.S. 4-70 as determined by NWMA test M-2. As is known in the art, the threshhold concentration requirements of halogenated phenols can also be lowered by turning to other classes of compounds such as copper salts, naphthenates, and quinolinoate; mercury salts, organometallics, etc. Threshhold concentrations under NWMA M-1-70 for these compounds can be as low as about 0.1% by weight.

For an extensive description of the commonly used monohydric halophenols, see U.S. Pat. No. 3,695,920 (Hill), issued Oct. 3, 1972. Of the various phenolic compounds discussed by Hill, the tetrahalo and pentahalo phenols are preferred. The most readily available of these is pentachlorophenol, hereinafter referred to as PCP. PCP is a crystalline material which can be dissolved in a variety of solvents. As pointed out previously, it is plasticized and thus made more effective by polymeric polyols. It is very mildly acid; it can be neutralized with organic or inorganic bases and can form phenolate salts.

An important adjunct to the wood preservative agent in compositions of this invention is the water repellency material. As is known in the art, waxes such as the paraffin waxes are effective water repellent agents for wood. See U.S. Pat. No. 3,600,408 (Bursack et al), issued Aug. 17, 1971. Paraffin waxes have been used for this purpose for decades. For a more detailed description of various types of waterproofing waxes, see U.S. Pat. No. 3,061,508 (Morriss et al), issued Oct. 30, 1962; U.S. Pat. No. 3,281,318 (Stutz), issued Oct. 25, 1966; and U.S. Pat. No. 3,369,921 (Stutz), issued Feb. 20, 1968 (column 7, lines 20–23). As pointed out in the '318 Stutz patent, all waxes generally possess similar characteristics of feel, consistency, melting point, water-insolubility or repellency, and the like. These are essentially physical properties, since the compounds and materials included within the scope of the term "wax" can vary widely in chemical composition and structure. However, all waxes (even all hydrocarbon or petroleum waxes) are not equally effective in their ability to meet the 60% water repellency standard for wood (NWMA I.S. 4-70), particularly when one chooses to set a short time limit on the wax treatment (in this invention, far less than the traditional three-minute soak) and a very low limit on wax concentration in the treating solution (in this invention, far less than the traditional 3–6 wt.-% e.g. less than 2 wt.-%). The preferred wax is a paraffin-type hydrocarbon wax obtained from petroleum and available from American Mineral Spirits Company (AMSCO) Division of Union Oil Company under the trade designation "PB Wax Blend." This paraffin-type hydrocarbon wax is relatively low melting (the drop melt point, by ASTM D-127, is well below the 145° F.-plus range characteristic of petrolatums and microcrystalline waxes and is typically below 130° F.) and can contain about one-fourth to about one-third by weight of oil. Such low melting points are typical of scale waxes and slack waxes, which are obtained from paraffin distillates by chilling and pressing to yield a soft solid containing hydrocarbons below $C_{32}$ in chain length and below 450 in molecular weight. For example, the waxy solid portion of a "slack wax" can contain hydrocarbons in the $C_{18}$ to $C_{26}$ range (molecular weight about 280 to about 370). "Scale waxes" have been used in waterproofing of materials such as thread and in fabricating or waxing or coating a variety of building materials. See Clark and Hawley, *The Encyclopedia of Chemistry*, 2nd Ed., Van Nostrand Reinhold Co. Most slack wax is further refined to produce the fully refined paraffin wax of commerce.

Plasticizers

The polymeric polyols used to preserve the effectiveness of the PCP (or other halogenated phenol) are preferably high enough in equivalent weight (i.e. low enough in hydroxyl number) to be, for all practical purposes, non-volatile. Thus, these polyols should contain at least five repeating monomeric units, e.g. oxyalkylene units. Hydroxyl numbers ranging from 10 to 100 and equivalent weights ranging from about 500 to about 6,000 are ordinarily preferred for the polyols of compositions of this invention. The molecular weight of the polyol should be high enough to provide essentially zero volatility, but low enough to avoid problems of excessive viscosity, incompatibility, lack of commercial availability and difficulty of purification. More typically, the equivalent weight will range from about 750 to 2,000, and the functionality of the polyol will range from about 2.0 to about 4.0. The polyol should be inert toward construction or building materials that it may come in contact with in the course of utilizing treated and painted millwork of this invention. For example, poly(oxyethylene) polyols have less of a solvating effect upon some of the common elastomers and other polymers used in window and door units. Oxyethylene/oxypropylene block polymers and copolymers can also be included in the polyol chain.

All polyols do not work with equal effectiveness, and the preferred ones are "Niax" polyol LG-56 (trademark of Union Carbide Corporation( or "Polycin" 58 (trademark of Baker Caster Oil Company). The Niax polyol LG-56 has a viscosity of 490 centistokes at 25° C., an apparent specific gravity of 1.010 (20/20° C.), an average hydroxyl number of 56.1(mg of KOH/g), and a maximum acid number of 0.05. This polyol is soluble in lower alkanols such as isopropyl alcohol. It is generally compatible (or at least operative with) other ingredients of the composition.

The Solvent System

The solvent system of this invention serves several functions. First, its polar component helps to provide electrical conductivity. Under ideal conditions, this polar component can be the sole conductivity-improving agent. However, it can be difficult to maintain such ideal conditions, and it is vastly preferred to include a solid conductivity-improving agent, as will be discussed subsequently. Second, the solvent system provides a high volatile, extremely dilute solution of solids (less than 20% by weight and preferably less than 15% by weight) with rapid "flash-off" characteristics and a lack of significant detrimental effects upon a variety of paints and primers, including the alkyd and polyurea type. The solvent system as a whole has a low boiling point, generally well below 140° C. and more typically below 120° C. Ordinarily, more than 10% by weight of the solvent system should be the polar organic liquid (or mixture of liquids), the balance of the solvent system being made up of relatively low-boiling hydrocarbonaceous (including halogenated hydrocarbonaceous) liquids, preferably straight-run coal or petroleum distillates. The weight/weight ratio of the polar liquid component to the hydrocarbon liquid component can typically be in the range of 1:9 to 9:1. Surprisingly, minor amounts of the polar liquid (particularly lower alkanols) are effective, and the preferred amount of alkanol is 15 – 40% by weight, based on the entire treatment solution (e.g. 17 – 45% by weight of the solvent system).

The preferred polar organic liquids have a solubility in water greater than 5% by weight and a boiling point less than 120° C., both determined at normal ambient conditions. The $C_1$ through $C_4$ alcohols, particularly the alkanols, are preferred. Methanol, though technically operative, is ordinarily avoided because of its relatively higher toxicity as compared to ethanol and primary and secondary isobutyl alcohol. The butanols are less preferred because of their relatively lower volatility and water compatibility.

The lower alkanols could comprise up to 100% of the solvent systems of this invention, but this would be impractical for a variety of reasons, including the high cost (hence the need for solvent recovery) of the alkanol. Straight run distillants obtained from petroleum and coal and the like are relatively inexpensive and do not detract from the objectives of this invention, so long as they comprise less than about 90% by weight of the solvent system. These hydrocarbon liquids can be blended with the lower alkanols. Many relatively low boiling distillates consisting essentially of hydrocarbons (aliphatics and/or cycloaliphatics and/or aromatics) are available which have boiling ranges with upper limits below 140° C. or, more preferably, below 120° C. Monocyclic hydrocarbons and straight or branched alkanes (or mixtures thereof) can be selected to have boiling points or ranges from just above normal ambient (e.g. 35° C.) up to moderately elevated temperatures (e.g. 100° C.). Higher boiling petroleum naphthas such as V, M, and P naphtha, however, are preferably excluded from the solvent system, though they could be present in incidental amounts. Among the suitable commercially available distillates are the "Lacolenes" (trademark) and the "Troluoils" (trademark).

Conductivity-Improving Agents

As is known in the art, quaternary ammonium salts can be used to improve electrical conductivity for electrostatic spraying. However, the preferred conductivity-improving agents of this invention are basic or neutral solids which can be solvated by the lower alkanols, particularly by ethanol and the propanols. It has been found that the solids level of this agent in the treatment solution can be surprisingly low if the agent meets these criteria and, in addition, is capable of dissociation (substantially or completely) in aqueous media. Some neutral or substantially neutral salts such as calcium chloride and cupric sulfate can be solvated in ethanol, methanol, etc. but many other neutral salts such as sodium chloride are substantially insoluble in alcohols and are preferably not used in this invention. Basic alkali metal compounds, on the other hand, are particularly preferred. In addition to being soluble in ethanol and the propanols, they also serve to neutralize the very mild acidity of the PCP. The alkali metal hydroxides such as NaOH are preferred both for reasons of economics and effectiveness. (Barium oxide is slightly soluble in alcohols but is relatively expensive.) Less than 1% by weight of sodium hydroxide provides stable electrical conductivity for solutions of this invention. Other alkali metal compounds which are basic and are soluble in ethanol and propanol include the alkali metal alkoxides such as sodium ethoxide. Addition of sodium metal to the alcohol can, of course, form alkoxides in situ. The alkali metal phenolates are less preferred, and the sodium salt of PCP will not, by itself, provide the advantages of sodium hydroxide in the context of this invention.

The conductivity-improving effectiveness of inexpensive, inorganic bases such as NaOH is believed to be a surprising feature of this invention, even with respect to other nonconductive substrates such as plastic and glass.

Miscellaneous Ingredients

Any of the ingredients commonly used in wood preservative solutions which would not interfer with the objectives of this invention can be used. Among such ingredients are the metal inhibitors or sequestering agents. It can be particularly important to inhibit the action of iron. A number of compositions are commercially available for this purpose, including "Santolene C" (trademark of Monsanto) as well as the conventional chelating agents such as EDTA and its salts. See U.S. Pat. No. 3,600,408 regarding the use of Santolene C.

Other undesirable side reactions and the like resulting from the use of preservative solutions can be mitigated in part by the use of PCP which is substantially dioxin free.

Amounts Used in Formulations of this Invention

The following table illustrates the proportions of materials used in halogenated phenol containing preparatory treatment solutions of this invention.

| Ingredient | Percent By Weight | | |
|---|---|---|---|
| | Broad | Preferred | Optimum |
| Halogenated phenol (e.g. PCP) | 1–10 | 3–6 | 5–6 |
| Polyol | 1–8 | 1–5 | 2–4 |
| Wax | 0.1–2 | 0.1–1 | 0.4–0.8 |
| Iron Inhibitor | 0–1 | 0–0.5 | 0.05–0.2 |
| Basic Alkali Metal Compound | 0–2 | 0.1–1 | 0.3–0.8 |
| Solvent System: | 80–97 | 85–95 | 90–92 |
| Alcohol Component* | 8–97 | 17–45 | 17–40 |
| Hydrocarbon distillate component | qs–100 | qs–100 | qs–100 |

*Based on total system

In the following non-limiting Examples, parts and percentages are by weight unless otherwise indicated.

EXAMPLE 1

The following composition was used in a preparatory treatment bath in an in-line wood preservation/electrostatic coating process of this invention. The production line and bath were arranged to provide a 15 second treatment for the wood. This treatment and the subsequent evaporation were carried out at normal ambient temperature and pressure. The wood was then electrostatically spray painted with a polyurea primer. An alkyd primer appeared to work equally well in the process.

| Ingredient | Percent by Weight |
|---|---|
| PCP (pentacholophenol) technical grade, essentially dioxin free | 5.2 |
| "Niax" polyol LG-56 (trademark of Union Carbide Corp.) | 3.0 |
| PB WaxBlend (waterproofing wax supplied by Amsco Co.) | 0.6 |
| "Santolene" C (iron inhibitor, trademark of Monsanto) | 0.1 |
| Sodium hydroxide (caustic soda), technical grade flake | 0.5 |
| Industrial isopropyl alcohol, 95–99% by weight purity | 35.0 |
| "Troluoil" (trademark for low boiling petroleum distillate) | 55.6 |
| Total Weight % | 100.0 |

The density of the above solution was about 6.54 pound per gallon at 70° F.

EXAMPLE 2

The following composition was used in the same manner as the composition of Example 1 with similar results. However, total solids were higher, reflecting the greater concentrations of the quaternary amine conductor. Accordingly, the sodium hydroxide conductor of Example 1 is preferred.

| Ingredient | Percent by Weight |
|---|---|
| PCP, technical grade, dioxine-free | 5.2 |
| "Polycin" 58 (trademark for polyol) | 3.0 |
| "PB WaxBlend" (trademark) | 0.6 |
| "Santolene" C (trademark) | 0.1 |
| "ECC-125" conductor (trade designation for quaternary amine salt) | 3.8 |
| Solvent System (80 volume % super lacolene hydrocarbon and 20 volume % Industrial Solvent 900*) | 87.3 |
| Total Weight% | 100.0 |

*Denatured ethanol containing, as additional denaturants isopropyl alcohol and methyisobutyl ketone.

What is claimed is:

1. A process for the preservation and electrostatic coating of a wooden substrate with a coating which is adhered to the substrate; said process comprising the steps of:
   a. placing the wooden substrate in substantially continuous motion with a conveying means;
   b. directing the resulting substantially continuous motion of said wooden substrate through a treatment zone for treatment of said wooden substrate with a liquid means comprising a liquid solution for preserving the wood and improving its electrical conductivity, said liquid solution comprising:
      an amount, at least equal to the threshold concentration, as determined by test NWMA-M-1-70, of a plasticized biocidal wood preservative with toxicity toward Lenzites Trabea Pers. ex. Fr., Madison 617, A.T.C.C., said wood preservative comprising at least one biocidal agent selected from the group consisting of a copper salt, a mercury salt, an organometallic compound, and a phenolic compound; said amount being within the range of 0.1–10% by weight;
      an amount of a paraffin wax sufficient to provide said wooden substrate with at least 60% water repellency, as determined by NWMA test M-2, said paraffin wax having a drop melt point, by ASTM D-127, below 145° F., said amount being less than 2% by weight of said solution, and about 80 to about 99% by weight of a substantially non-aqueous, organic solvent system comprising at least 10% by weight of a polar organic liquid with a solubility in water greater than 5 wt. % and a boiling point at normal ambient conditions of less than 120° C.;
   c. directing the said substantially continuous motion of the treated wooden substrate, emerging from said treatment zone, through an evaporation zone to an electrostatic spraying zone; and
   d. electrostatically spraying the treated wooden substrate with a coating composition in said electrostatic spraying zone.

2. A process according to claim 1 wherein said treatment zone and said evaporation zone are maintained at substantially normal ambient temperature and pressure conditions.

3. A process according to claim 1 wherein said wooden substrate is one of a series of elongated wooden articles and said treatment zone comprises a liquid bath of said liquid solution.

4. A process according to claim 1 wherein said liquid solution comprises:
   3–6% by weight of a halogenated phenolic preservative;
   1–5% by weight of a polyether polyol having an equivalent weight in the range of 500–6,000;
   0.1–1% by weight of said wax;
   0–0.5% by weight of a metal sequestering or inhibiting agent;
   0–5% by weight of an ionizable salt or base which is soluble in lower alkanols or liquid hydrocarbons;
   85–95% by weight of a solvent system comprising a $C_1 - C_4$ alkanol and a liquid hydrocarbon solvent having a boiling range below 140° C., the weight/weight ratio of said alkanol to said hydrocarbon being in the range of 1:9 to 9:1.

5. A process according to claim 4 wherein said solution consists essentially of:
   5–6% by weight pentachloro phenol which is essentially dioxin free;
   2–4% of said phenol;
   0.4–0.8% by weight of said wax;
   0.1–1% of an alkali metal basic compound which is soluble in lower alkanols;
   10–50% by weight of a $C_2 - C_4$ alkanol, and essentially the balance to 100% of said composition comprising a hydrocarbon liquid material having a boiling point or boiling range below 120° C.

6. A process according to claim 5 wherein the solvent system comprises 90–92% of said solution.

7. A process according to claim 1 wherein the length of time in said treatment zone is 1–20 seconds.

8. A wooden millwork product treated and electrostatically coated according to the process of claim 1.

9. A composition for preserving and improving the electrical conductivity of a wooden substrate comprising:
   3–6% by weight of a pentachlorophenol;
   1–5% by weight of a polyether polyol having an equivalent weight in excess of 500;
   0.1–1% by weight of a paraffin wax sufficient to provide the wooden substrate with at least 60% water repellency, as determined by NWMA test M-2 and having a drop melt point, by ASTM D-127, below 145° F.;
   0–0.5% by weight of a metal sequestering or inhibiting agent;
   0.1–1% by weight of an alkali metal hydroxide;
   85–85% by weight of a solvent system comprising a $C_2$ or $C_3$ alkanol and a liquid hydrocarbon solvent having a boiling range below 140° C., the weight/weight ratio of said alkanol to said hydrocarbon being in the range of 1:9 to 9:1.

10. In a process for the electrostatic spraying of wooden articles, the improvement which comprises a preparatory treatment of said articles comprising the step of immersing said articles in the composition of claim 9.

* * * * *

UNITED STATES PATENT OFFICE

CERTIFICATE OF CORRECTION

Patent No. 4,013,804 Dated March 22, 1977

Inventor(s) Stanley A. Gruetzman

It is certified that error appears in the above-identified patent and that said Letters Patent are hereby corrected as shown below:

Column 3, line 20, for "capabie" read --capable--.
Column 3, line 26, "solids" should be in quotes, --"solids"--.
Column 3, line 55, "in-line" should be in quotes, --"in-line"--.
Column 4, line 68, for "of organo-metallic" read --or organo-metallic--.
Column 8, line 54, "Threshhold concentrations" should be in quotes, --"Threshhold concentrations"--.
Column 9, line 49, "slack wax" should be in quotes, --"slack wax"--.
Column 12, lines 1 and 2, "Santolene C" should be in quotes, --"Santolene C"--.
Column 14, line 59, for "85-85" read --85-95--.

Signed and Sealed this twenty-third Day of August 1977

[SEAL]

Attest:

RUTH C. MASON
Attesting Officer

C. MARSHALL DANN
Commissioner of Patents and Trademarks